US010286443B2

(12) United States Patent
Iwasa et al.

(10) Patent No.: US 10,286,443 B2
(45) Date of Patent: May 14, 2019

(54) RING ROLLING MILL AND METHOD FOR MANUFACTURING RING ROLLED MATERIAL

(71) Applicant: HITACHI METALS, LTD., Tokyo (JP)

(72) Inventors: Naoyuki Iwasa, Shimane (JP); Tsuyoshi Fukui, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 449 days.

(21) Appl. No.: 15/084,009

(22) Filed: Mar. 29, 2016

(65) Prior Publication Data

US 2016/0288196 A1 Oct. 6, 2016

(30) Foreign Application Priority Data

Mar. 31, 2015 (JP) ..... 2015-071863

(51) Int. Cl.
*B21H 1/06* (2006.01)

(52) U.S. Cl.
CPC ..... *B21H 1/06* (2013.01)

(58) Field of Classification Search
CPC .... B21H 1/06; B21H 1/12; B21H 9/00; B21B 5/00; B21B 31/18; B21B 13/142; B21D 53/10; B21D 53/16
See application file for complete search history.

(56) References Cited

U.S. PATENT DOCUMENTS 3,824,820 A * 7/1974 Jeuken ..... B21H 1/06 72/110
4,869,088 A * 9/1989 Kadotani ..... B21H 1/06 72/11.1
6,240,761 B1 * 6/2001 Suzuki ..... B21H 1/06 72/106

FOREIGN PATENT DOCUMENTS

JP 62-101333 5/1987
JP 62101333 A * 5/1987 ..... B21B 5/00
JP 2859446 B2 * 2/1999 ..... B21H 1/06

OTHER PUBLICATIONS

Original document without Eng abstract JP2859446B2 to Hosada is attached.*

(Continued)

*Primary Examiner* — Peter Dungba Vo
*Assistant Examiner* — Joshua D Anderson
(74) *Attorney, Agent, or Firm* — Rankin, Hill & Clark LLP

(57) ABSTRACT

A ring rolling mill includes: a rotary drive main roll and a mandrel roll, which are for reducing the thickness of and rolling a ring-shaped material from the radial direction; a pair of rotary drive axial rolls for reducing the thickness of and rolling the ring-shaped material from the axial direction; a measuring roll for measuring the diameter of the ring-shaped material during rolling; and a speed control unit for controlling the speed of the axial rolls. The speed control unit is configured to repeat measuring the diameter at predetermined time intervals Δt and comparing a measurement value $L_t$ of the diameter at time t and a measurement value $L_{t+\Delta t}$ of the diameter at time t+Δt, and the speed control unit is further configured to maintain the speed of the axial rolls unchanged upon the result of the comparison being $L_{t+\Delta t}<L_t$.

4 Claims, 5 Drawing Sheets

(56) References Cited

OTHER PUBLICATIONS

Original document with English abstract MTJP62101333A to Sato is attached.*
Machine translation from Proquest of MTJP2859446B2 to Hosada is attached.*
Machine translation from Proquest of MTJP62101333A to Sato is attached.*

* cited by examiner

RING ROLLING MILL AND METHOD FOR MANUFACTURING RING ROLLED MATERIAL

CROSS-REFERENCE TO RELATED APPLICATION

This application claims priority from Japanese Patent Application No. 2015-071863 filed with the Japan Patent Office on Mar. 31, 2015, the entire content of which is hereby incorporated by reference.

BACKGROUND

1. Technical Field

The present disclosure relates to a ring rolling mill and a method for manufacturing a ring rolled material using the ring rolling mill.

2. Description of the Related Art

A ring rolling mill is an apparatus for obtaining a ring rolled material of a predetermined shape by hot rolling a ring-shaped material. For example, a ring-shaped super alloy product such as a turbine disk of an engine for an aircraft is manufactured by carrying out machining on a ring rolled material formed by hot rolling (ring rolling) using the ring rolling mill. Such a ring rolling mill includes, for example, a rotary drive main roll, a non-drive mandrel roll, and a pair of rotary drive axial rolls, as a basic configuration. The rotary drive main roll and the non-drive mandrel roll reduce the thickness of and roll a ring-shaped material from the radial direction. The pair of rotary drive axial rolls reduces the thickness of and rolls the ring-shaped material from the axial direction.

When the ring-shaped material is rolled using the above-mentioned ring rolling mill, the circumference, that is, the ring diameter, increases both by the radial reduction and by the axial reduction. Therefore, the positions and rotational speed of the axial rolls are appropriately controlled in accordance with the increase of the diameter. For example, JP-A-62-101333 discloses a speed control apparatus of a rotary forming apparatus intended for, for example, the solution of a disadvantage and inconvenience in terms of the operation of the rotary forming apparatus. The speed control apparatus includes sensors that detect the rotational speeds of a king roll and upper and lower axial rolls, a sensor that detects the position of an axial rolling unit including the upper and lower axial rolls, and a sensor that detects the position of a cylindrical material. The speed control apparatus includes a computing unit that commands the rotational speed of the upper and lower axial rolls by a computation using a king roll rotational speed signal, and a computing unit that commands the position of the axial rolling unit by a computation that uses a positional signal of the cylindrical material.

SUMMARY

A ring rolling mill includes: a rotary drive main roll and a mandrel roll, which are for reducing the thickness of and rolling a ring-shaped material from the radial direction; a pair of rotary drive axial rolls for reducing the thickness of and rolling the ring-shaped material from the axial direction; a measuring roll for measuring the diameter of the ring-shaped material during rolling; and a speed control unit for controlling the speed of the axial rolls. The speed control unit is configured to repeat measuring the diameter at predetermined time intervals Δt, comparing a measurement value $L_t$ of the diameter at time t and a measurement value $L_{t-\Delta t}$ of the diameter at time t+Δt, and setting the speed of the axial rolls based on the result of the comparison, and the speed control unit is further configured to maintain the speed of the axial rolls unchanged upon the result of the comparison being $L_{t+\Delta t}<L_t$.

DESCRIPTION OF THE EMBODIMENTS

Figure 1:
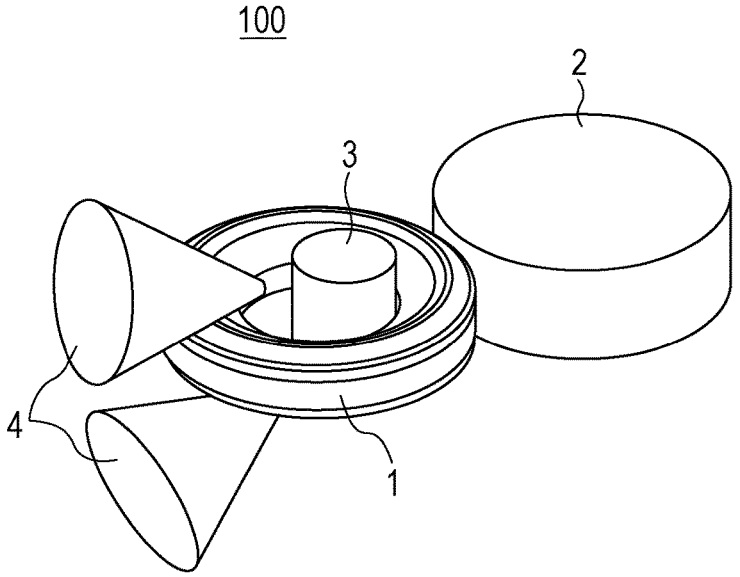
FIG. 1 is a perspective view of a ring rolling mill according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to, for example, the speed control apparatus of the rotary forming apparatus described in JP-A-62-101333, it becomes possible to control the positions and rotational speed of the axial rolls based on information on the size and the like of the ring-shaped material. However, in a case of ring rolling, the ring-shaped material that is being rolled is not always of a perfect circle. On the contrary, it is highly likely to be of a shape with low roundness, such as an elliptical shape. In this case, if the rotational speed and positions of the axial rolls are controlled by a computation output based on an outer circumferential position information of the ring-shaped material, control by the computation output varies largely depending on the difference between the major axis side and the minor axis side, and becomes unstable. Hence, variations are reduced by, for example, reducing the rolling speed and the like to finish a product of required dimensions and precision. This lengthens the time required for ring rolling.

One object of the present disclosure is to provide a ring rolling mill and a method for manufacturing a ring rolled material, which are suitable for stable shape control in ring rolling.

A ring rolling mill according to an aspect of the present disclosure includes: a rotary drive main roll and a mandrel roll, which are for reducing the thickness of and rolling a ring-shaped material from the radial direction; a pair of rotary drive axial rolls for reducing the thickness of and rolling the ring-shaped material from the axial direction; a measuring roll for measuring the diameter of the ring-shaped material during rolling; and a speed control unit for controlling the speed of the axial rolls. The speed control unit is configured to repeat measuring the diameter at predetermined time intervals Δt, comparing a measurement value $L_t$ of the diameter at time t and a measurement value $L_{t+\Delta t}$ of the diameter at time t+Δt, and setting the speed of the axial rolls based on the result of the comparison, and the speed control unit is further configured to maintain the speed of the axial rolls unchanged upon the result of the comparison being $L_{t+\Delta t}<L_t$. The speed control unit may be configured to calculate and set a new speed of the axial rolls based on $L_{t+\Delta t}$ upon the result of the comparison being $L_{t+\Delta t}\geq L_t$.

The speed control unit may be configured to maintain the speed of the axial rolls unchanged upon the result of the comparison being $[L_{t+\Delta t}-L_t]/L_t>a$ (a is a predetermined allowable error rate). In this case, the speed control unit may be configured to calculate and set a new speed of the axial rolls based on $L_{t+\Delta t}$ upon the result of the comparison being $L_{t+\Delta t}\geq L_t$ and $[L_{t+\Delta t}-L_t]/L_t\leq a$.

A method for manufacturing a ring rolled material according to an aspect of the present disclosure includes: reducing the thickness of and rolling a ring-shaped material from the radial direction; reducing the thickness of and rolling the ring-shaped material from the axial direction by a pair of rotary drive axial rolls; measuring the diameter of the ring-shaped material during rolling; and controlling the speed of the axial rolls. The controlling the speed of the axial rolls may include the repeated performance of measuring the diameter at predetermined time intervals Δt, comparing a measurement value $L_t$ of the diameter at time t and a measurement value $L_{t-\Delta t}$ of the diameter at time t+Δt, and setting the speed of the axial rolls based on the result of the comparison, and the setting the speed of the axial rolls based on the result of the comparison includes maintaining the speed of the axial rolls unchanged upon the result of the comparison being $L_{t+\Delta t}<L_t$. The setting the speed of the axial rolls based on the result of the comparison may further include calculating and setting a new speed of the axial rolls based on $L_{t+\Delta t}$ upon the result of the comparison being $L_{t+\Delta t}\geq L_t$.

The setting the speed of the axial rolls based on the result of the comparison may further include maintaining the speed of the axial rolls unchanged upon the result of the comparison being $[L_{t+\Delta t}-L_t]/L_t>a$ (a is a predetermined allowable error rate). The setting the speed of the axial rolls based on the result of the comparison may further include calculating and setting a new speed of the axial rolls based on $L_{t+\Delta t}$ upon the result of the comparison being $L_{t+\Delta t}\geq L_t$ and $[L_{t+\Delta t}-L_t]/L_t\leq a$.

According to the ring rolling mill and the method for manufacturing a ring rolled material according to an aspect of the present disclosure, stable shape control in ring rolling becomes possible.

A ring rolling mill according to one embodiment of the present disclosure includes: a rotary drive main roll and a mandrel roll, which are for reducing the thickness of and rolling a ring-shaped material from the radial direction; a pair of rotary drive axial rolls for reducing the thickness of and rolling the ring-shaped material from the axial direction; a measuring roll for measuring the diameter of the ring-shaped material during rolling; and a speed control unit for controlling the speed (rotational speed) of the axial rolls.

The speed control unit is configured to repeat measuring the diameter at predetermined time intervals Δt, comparing a measurement value $L_t$ of the diameter at time t and a measurement value $L_{t+\Delta t}$ of the diameter at time t+Δt, and setting the speed of the axial rolls based on the result of the comparison. The speed control unit is further configured to maintain the speed of the axial rolls unchanged upon the result of the comparison being $L_{t+\Delta t}<L_t$.

If the roundness of the ring-shaped material is reduced during rolling, and the ring-shaped material is turned into an elliptical shape, the diameter of the ring-shaped material read by the measuring roll changes periodically. What is directly read by the measuring roll is the position of an outer circumferential surface of the ring-shaped material. The opposing rotary drive main roll is not displaced in the radial direction. Accordingly, the read position of the outer circumferential surface can be treated as a measurement value of the diameter of the ring-shaped material.

In this case, if the ring-shaped material is a perfect circle, it is impossible for the ring-shaped material to be reduced in diameter during the process of ring rolling. In spite of that, when the diameter of the ring-shaped material, which changes periodically, is used as it is for a computation of the control speed, if the ring-shaped material is a perfect circle, a computation is performed based on an impracticable change of shape. The speed of the axial rolls is set based on the result of the computation. Hence, the axial roll speed control becomes unstable. In contrast, in the one embodiment of the present disclosure, control of the speed of the axial rolls based on information on an impracticable change of shape is avoided. Consequently, it is possible to stabilize the control of the speed of the axial rolls.

Embodiments of a ring rolling mill and a method for manufacturing a ring rolled material according to the present disclosure are specifically described hereinafter with reference to the drawings. However, the technology of the present disclosure is not limited to the following embodiments. Moreover, a configuration described in each embodiment can also be applied to another embodiment as long as it does not impair the gist of the other embodiment. In this case, overlapping descriptions are omitted as appropriate.

First Embodiment of Ring Rolling Mill

Figure 2:
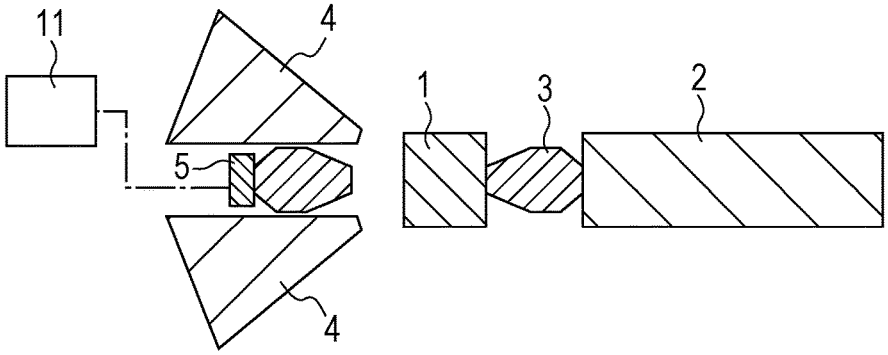
FIG. 2 is a cross-sectional view of the ring rolling mill illustrated in FIG. 1.

FIG. 1 is a perspective view illustrating a schematic arrangement of a ring rolling mill according to one embodiment of the present disclosure. FIG. 2 is a schematic diagram of the cross-section of the ring rolling mill. A ring rolling mill 100 illustrated in FIG. 1 includes, as mechanical elements, a rotary drive main roll 2, a mandrel roll 3, a pair of rotary drive axial rolls 4, and a measuring roll 5. The rotary drive main roll 2 and the mandrel roll 3 reduce the thickness of and roll a ring-shaped material 1 from the radial direction. The pair of rotary drive axial rolls 4 reduces the thickness of and rolls the ring-shaped material 1 from the axial direction. The measuring roll 5 measures the diameter of the ring-shaped material 1 that is being rolled. The rotary drive main roll 2 and the axial rolls 4 are driven by motors. The mandrel roll 3 rotates freely. The basic configuration of the mechanical elements may be similar to that of a known ring rolling mill.

The rotary drive main roll 2 rotates the ring-shaped material 1 in contact with an outer circumference side of the ring-shaped material 1. The non-drive and driven mandrel roll 3 is placed facing the rotary drive main roll 2. The axis of the mandrel roll 3 is parallel to the axis of the rotary drive main roll 2.

The pair of conical rotary drive axial rolls 4 is placed in such a manner as to be symmetrical about the ring-shaped material 1 and to locate their vertexes inside the ring-shaped material. The speed of the axial rolls 4 is controlled to make it possible to control the shape of the ring-shaped material 1. The measuring roll (touch roll) 5 detects the position of an outer circumferential surface of the ring-shaped material 1 in contact with the outer circumferential surface of the ring-shaped material 1. The diameter (outer diameter) of the ring-shaped material 1 is measured from the relationship between the position of the outer circumferential surface of the ring-shaped material 1 and the position of the rotary drive main roll 2 that is immovable in the horizontal direction. The diameter is used to control the speed of the axial rolls 4. The positions of the pair of rotary drive axial rolls 4 are detected. Accordingly, it is possible to obtain a spacing between the pair of rotary drive axial rolls 4. An axial thickness T of the ring-shaped material 1 can be measured based on the spacing.

Figure 3:
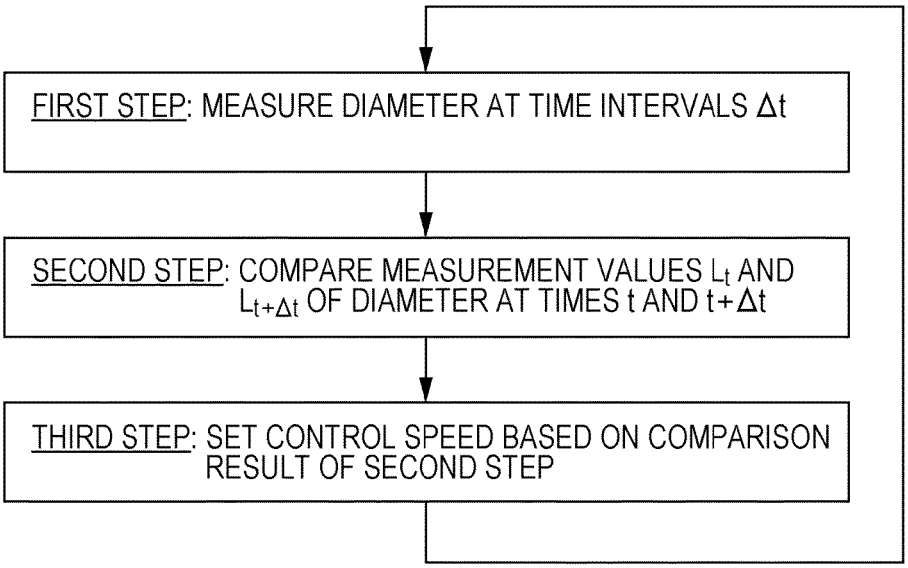
FIG. 3 illustrates the flow of control of a speed control unit, in the ring rolling mill and a method for manufacturing a ring rolled material according to the embodiment.

The ring rolling mill 100 further includes a speed control unit 11 that controls the speed of the axial rolls 4. FIG. 3 illustrates an example of a flowchart of speed control to be executed by such a speed control unit 11. The speed control unit 11 repeats the following first to third steps to control the speed of the axial rolls 4. In the first step, the speed control unit 11 measures the diameter of the ring-shaped material 1 at predetermined time intervals Δt. In the second step, the speed control unit 11 compares a measurement value $L_t$ of the diameter of the ring-shaped material 1 at time t, and a measurement value $L_{t+\Delta t}$ of the diameter of the ring-shaped material 1 at time t+Δt. In the third step, the speed control unit 11 sets the speed (control speed) of the axial rolls 4 based on the comparison result of the second step. Dimensional information of the ring-shaped material 1 that is being rolled is fed back to the speed of the axial rolls 4. Accordingly, rolling conditions can be optimized.

Figure 4:
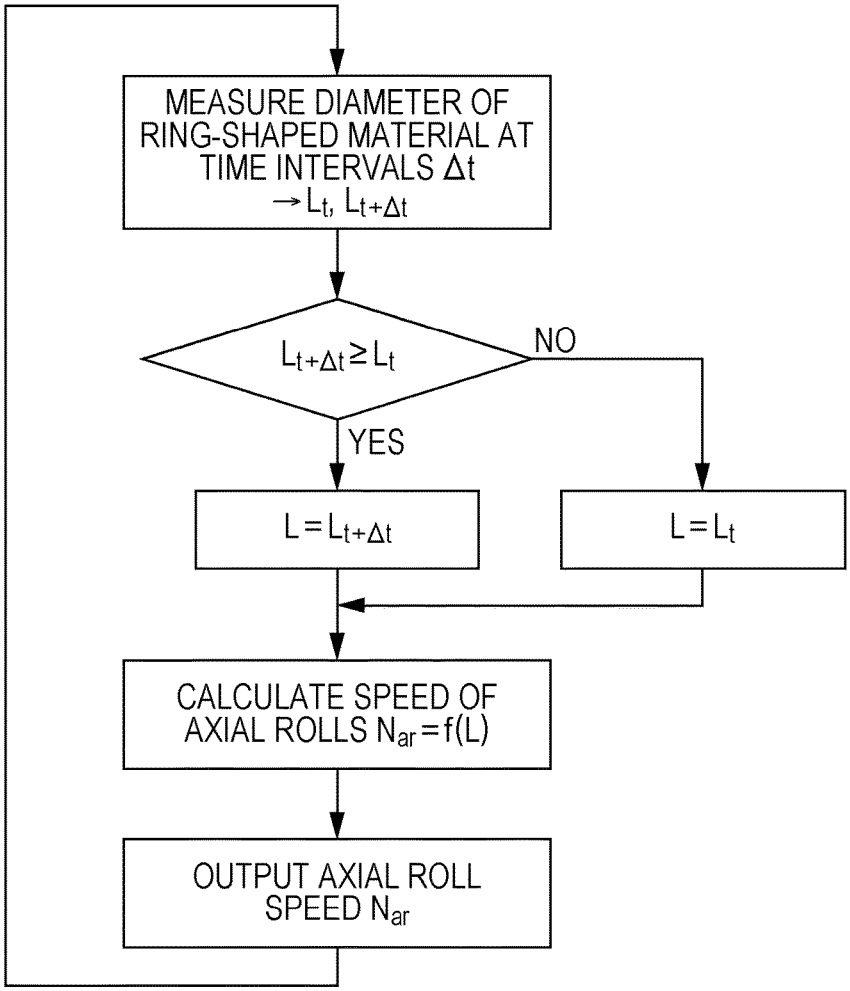
FIG. 4 illustrates a specific example of the flow of control of setting the speed, which is performed by the speed control unit.

The speed control unit 11 calculates and sets a new control speed based on $L_{t+\Delta t}$ in the third step if the comparison result of the second step is $L_{t+\Delta t} \geq L_t$. The speed control unit 11 maintains the control speed unchanged if the comparison result of the second step is $L_{t+\Delta t} < L_t$. FIG. 4 illustrates an example of a specific control flow that achieves such control.

After the start of ring rolling, the speed control unit 11 measures the diameter of the ring-shaped material 1 at the time intervals Δt by the above-mentioned detection of the position of the ring-shaped material 1 using the measuring roll 5. In other words, the speed control unit 11 measures a diameter $L_t$ of the ring-shaped material 1 at the time t, and measures a diameter $L_{t+\Delta t}$ of the ring-shaped material 1 after a lapse of time Δt. Next, the speed control unit 11 compares the diameter $L_{t+\Delta t}$ and the diameter $L_t$ and, if $L_{t+\Delta t}$ is equal to or more than $L_t$, stores $L_{t+\Delta t}$ as a diameter parameter L that is used to calculate the speed of the axial rolls 4. On the other hand, if $L_{t+\Delta t}$ is less than $L_t$, the speed control unit 11 stores $L_t$ as the diameter parameter L that is used to calculate the speed of the axial rolls 4. Next, the speed control unit 11 calculates a speed $N_{ar}$ of the axial rolls 4 based on the diameter parameter L and a preset equation $N_{ar}=f(L)$. Such an equation is simply required to be determined based on the specifications and the like of the apparatus. For example, the following equation can be used.

$$N_{ar}=(i_s \cdot N_{sm} \cdot D_s \cdot (D-2x))/(2i_a \cdot \sin(\theta_a/2) \cdot (L-x) \cdot D)$$

$i_s$: main roll reduction ratio $N_{sm}$: main roll motor speed [rpm]

$D_s$: diameter of the main roll [mm]

D: diameter (outer diameter) of the ring-shaped material [mm]

x (=βT): peripheral speed adjustment position [mm], β: arbitrary constant, T: thickness of the ring-shaped material $i_a$: axial roll reduction ratio $\theta_a$: inclination angle of the axial roll [rad]

The speed control unit 11 outputs the speed $N_{ar}$ of the axial rolls 4, which has been calculated by the above equation, to a motor, and controls (sets) the speed (rotational speed) of the axial rolls 4. It is continued to measure the diameter of the ring-shaped material 1 after each lapse of Δt. In other words, the flow of control illustrated in FIG. 4 is repeatedly continued.

That when $L_{t+\Delta t}$ is measured, $L_{t+\Delta t}$ is stored as the diameter parameter L means that a new control speed is calculated and set by the above equation. On the other hand, that when $L_{t+\Delta t}$ is measured, $L_t$ is stored as the diameter parameter L means that the speed $N_{ar}$ calculated by the equation becomes invariant and the control speed is maintained unchanged. As described above, the measurement result, which is $L_{t+\Delta t} < L_t$, is an impossible result if the shape of the ring-shaped material 1 is a perfect circle. The speed control unit 11 avoids changing the speed of the axial rolls 4 based on such a measurement result. Consequently, stable ring rolling becomes possible.

Figure 5:
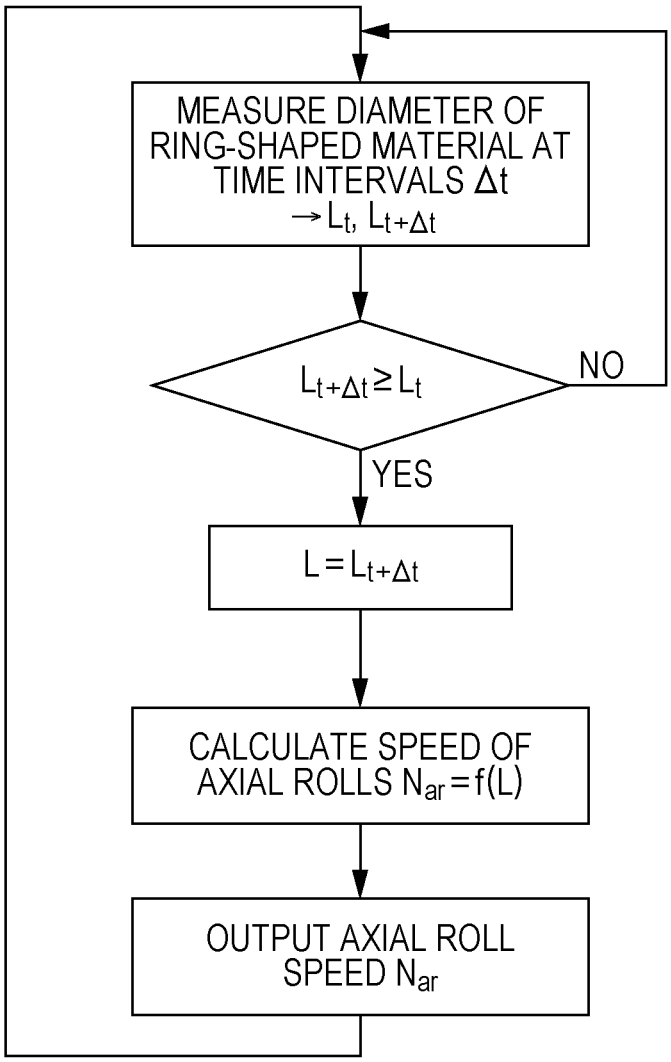
FIG. 5 illustrates another specific example of the flow of control of setting the speed, which is performed by the speed control unit.

The flow of control for maintaining the control speed unchanged in the case where the comparison result of the second step is $L_{t+\Delta t} < L_t$ is not limited to the embodiment illustrated in FIG. 4. FIG. 5 illustrates another embodiment of the flow of the control of the speed of the axial rolls 4. In the embodiment illustrated in FIG. 5, the process in the case of $L_{t+\Delta t} < L_t$ is different from that of the embodiment of FIG. 4. The other processes are similar to those of the embodiment of FIG. 4. In the flow of control illustrated in FIG. 5, if $L_{t+\Delta t}$ is less than $L_t$ as the result of the comparison of $L_{t+\Delta t}$ and $L_t$, the speed control unit 11 skips the calculation and setting of a new speed of the axial rolls 4, and shifts to the next diameter measurement step (diameter measurement flow). Also in such a flow of control, it is possible to maintain the control speed unchanged if $L_{t+\Delta t} < L_t$.

Δt may be a constant interval during ring rolling. Moreover, the length of Δt is not especially limited. Δt may be, for example, values of 1/50 to 1/30 of the rotation cycle of the ring (for example, 0.05 to 0.10 sec).

The speed control by the speed control unit 11 may start, for example, at the time when approximately 10 seconds elapse after the start of ring rolling. A value based on the dimension of the ring-shaped material 1 before rolling may be used as the initial value of the diameter $L_t$.

<Ring Rolling Method>

The above-mentioned method for manufacturing a ring rolled material using the ring rolling mill is described below with reference to FIGS. 1 and 2. As described above, the ring rolling mill 100 used includes the rotary drive main roll 2, the mandrel roll 3, the pair of rotary drive axial rolls 4, the measuring roll 5, and the speed control unit 11. The rotary drive main roll 2 and the mandrel roll 3 reduce the thickness of and roll the ring-shaped material 1 from the radial direction. The pair of rotary drive axial rolls 4 reduces the thickness of and rolls the ring-shaped material 1 from the axial direction. The measuring roll 5 measures the diameter of the ring-shaped material 1 that is being rolled. The speed control unit 11 controls the speed of the axial rolls 4. The configuration of the ring rolling mill 100 is as described above; accordingly, its description is omitted.

The mandrel roll 3 is placed inside the ring-shaped material 1. The rotary drive main roll 2 is placed outside the ring-shaped material 1. The ring-shaped material 1 comes into contact with the rotary drive main roll 2 and accordingly is rotated. The mandrel roll 3 is displaced toward the rotary drive main roll 2 based on a preset rolling schedule. Consequently, the ring-shaped material 1 is reduced in thickness in the radial direction. Moreover, the ring-shaped material 1 is reduced in thickness in the axial direction by the pair of rotating axial rolls 4.

As described above, the speed control unit 11 repeats the following first to third steps to control the speed of the axial rolls 4. In the first step, the speed control unit 11 measures the diameter of the ring-shaped material 1 at the predetermined time intervals Δt. In the second step, the speed control unit 11 compares the measurement value $L_t$ of the diameter of the ring-shaped material 1 at the time t and the measurement value $L_{t+\Delta t}$ of the diameter of the ring-shaped material 1 at the time t+Δt. In the third step, the speed control unit 11 sets the speed (control speed) of the axial rolls 4 based on the comparison result of the second step. The speed control unit 11 calculates and sets a new control speed based on $L_{t+\Delta t}$ in the third step if the comparison result of the second step is $L_{t+\Delta t} \geq L_t$. The speed control unit 11 maintains the control speed unchanged if the comparison result of the second step is $L_{t+\Delta t} < L_t$. The details of such a flow of control at the speed control unit 11 is as described above; accordingly, its description is omitted.

Second Embodiment of Ring Rolling Mill

Next, another embodiment (second embodiment) of the ring rolling mill 100 is described. In this embodiment, the flow of control by the speed control unit 11 is different from the flow of control of FIG. 4. Mechanical elements of the ring rolling mill 100 are similar to those of the first embodiment illustrated in FIGS. 1 and 2. In other words, the ring rolling mill 100 includes, as the mechanical elements, the rotary drive main roll 2, the mandrel roll 3, the pair of rotary drive axial rolls 4, and the measuring roll 5. The rotary drive main roll 2 and the mandrel roll 3 reduce the thickness of and roll a ring-shaped material 1 from the radial direction. The pair of rotary drive axial rolls 4 reduces the thickness of and rolls the ring-shaped material 1 from the axial direction. The measuring roll 5 measures the diameter of the ring-shaped material 1 that is being rolled. Such mechanical elements are similar to those of the first embodiment; accordingly, their detailed descriptions are omitted.

The ring rolling mill 100 of the second embodiment includes a speed control unit 11 that controls the speed of the axial rolls 4 as in the first embodiment. Moreover, the speed control unit 11 repeats the following first to third steps as in the first embodiment to control the speed of the axial rolls 4. In the first step, the speed control unit 11 measures the diameter of the ring-shaped material 1 at the predetermined time intervals Δt. In the second step, the speed control unit 11 compares a measurement value $L_t$ of the diameter of the ring-shaped material 1 at time t and a measurement value $L_{t+\Delta t}$ of the diameter of the ring-shaped material 1 at time t+Δt. In the third step, the speed control unit 11 sets the speed (control speed) of the axial rolls 4 based on the comparison result of the second step.

However, in the second embodiment, the speed control unit 11 calculates and sets a new control speed based on $L_{t+\Delta t}$ in the third step if the comparison result of the second step is $L_{t+\Delta t} \geq L_t$ and $[L_{t+\Delta t}-L_t]/L_t \leq a$ (a is a predetermined allowable error rate). The speed control unit 11 maintains the control speed unchanged if the comparison result of the second step is $L_{t+\Delta t} < L_t$ or $[L_{t+\Delta t}-L_t]/L_t > a$. In other words, the flow of control of the second embodiment is different from that of the first embodiment on the point in which the condition of the comparison of $[L_{t-\Delta t}-L_t]/L_t$ and a (a is the predetermined allowable error rate) is superimposed on the condition of the comparison of $L_{t+\Delta t}$ and $L_t$ in the second step.

Figure 6:
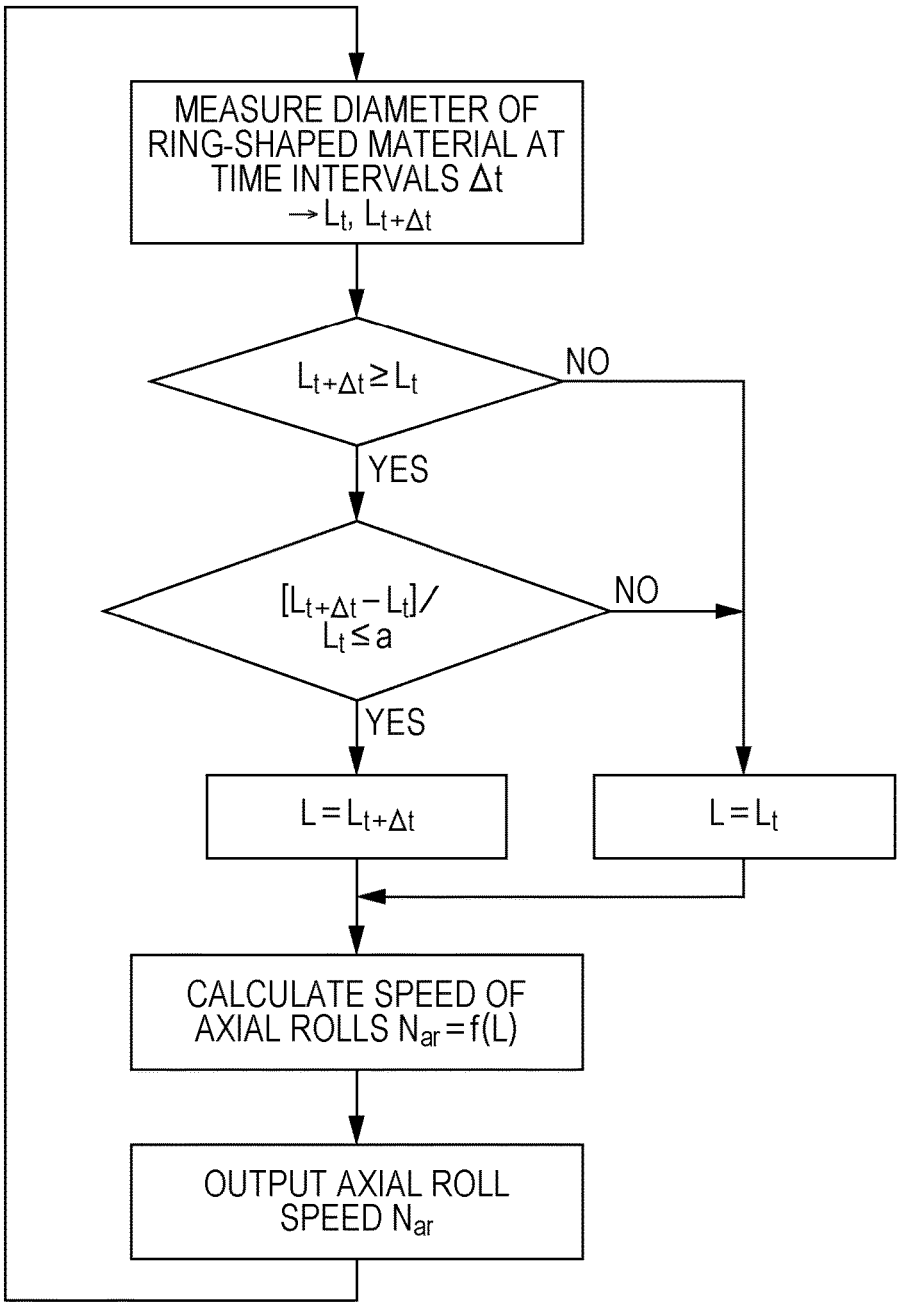
FIG. 6 illustrates another specific example of the flow of control of setting the speed, which is performed by the speed control unit.

When the ring-shaped material 1 is turned into an elliptical shape in the process of ring rolling, the measuring roll 5 also detects the dimension on the major diameter side. Especially when a new control speed of the axial rolls 4 is calculated and set based on the value measured by the measuring roll 5 if the roundness of the ring-shaped material 1 is low, the control of the speed of the axial rolls 4 becomes unstable. Hence, a variation tolerance on the measurement value of the diameter of the ring-shaped material 1 is set in the second embodiment. The speed control unit 11 maintains the control speed unchanged also if a variation in the diameter of the ring-shaped material 1 exceeds the variation tolerance. These points are different points of the second embodiment from the first embodiment. FIG. 6 illustrates a specific flow of control by the speed control unit 11 in the second embodiment.

After the start of ring rolling, the speed control unit 11 measures the diameter of the ring-shaped material 1 at time intervals Δt by the above-mentioned detection of the position of the ring-shaped material 1 using the measuring roll 5. In other words, the speed control unit 11 measures the diameter $L_t$ of the ring-shaped material 1 at the time t, and measures the diameter $L_{t+\Delta t}$ of the ring-shaped material 1 after a lapse of the time Δt. Next, the speed control unit 11 compares the diameter $L_{t+\Delta t}$ and the diameter $L_t$ and, if $L_{t+\Delta t}$ is equal to or more than $L_t$, proceeds to the next flow. On the other hand, if $L_{t+\Delta t}$ is less than $L_t$, the speed control unit 11 stores $L_t$ as a diameter parameter L that is used to calculate the speed of the axial rolls 4. If $L_{t+\Delta t}$ is equal to or more than $L_t$, the speed control unit 11 further compares $[L_{t+\Delta t}-L_t]/L_t$ and the preset allowable error rate a. If $[L_{t+\Delta t}-L_t]/L_t$ is equal to or less than the allowable error rate a, the speed control unit 11 stores $L_{t+\Delta t}$ as the diameter parameter L that is used to calculate the speed of the axial rolls 4. On the other hand, if $[L_{t+\Delta t}-L_t]/L_t$ exceeds the allowable error rate a, the speed control unit 11 stores $L_t$ as the diameter parameter L. Next, the speed control unit 11 calculates a speed $N_{ar}$ of the axial rolls 4 based on the diameter parameter L and a preset equation $N_{ar}=f(L)$. A method for calculating the speed $N_{ar}$ of the axial rolls 4 is similar to that of the first embodiment; accordingly, its description is omitted. The speed control unit 11 outputs the calculated speed $N_{ar}$ of the axial rolls 4 to the motor to control the speed of the axial rolls 4. It is continued to measure the diameter of the ring-shaped material 1 after each lapse of Δt. In other words, the flow of control illustrated in FIG. 6 is repeatedly continued. The allowable error rate a can be set as appropriate. The allowable error rate a may be, for example, 0.2 or more.

The flow of the comparison of $L_{t+\Delta t}$ and $L_t$ and the flow of the comparison of $[L_{t+\Delta t}-L_t]/L_t$ and a are not limited to the flow of control illustrated in FIG. 6. For example, the comparison order may be reversed. In other words, the comparison of $[L_{t+\Delta t}-L_t]/L_t$ and a may be made before the comparison of $L_{t+\Delta t}$ and $L_t$. Moreover, as in the flow illustrated in FIG. 5, if $[L_{t+\Delta t}-L_t]/L_t$ exceeds the allowable error rate a, or if $L_{t+\Delta t}$ is less than $L_t$, execution may shift to the next diameter measurement step.

The use of the ring rolling mill 100 of the second embodiment makes it possible to realize the method for manufacturing a ring rolled material suitable to carry out ring rolling stably. The flow of control by the speed control unit 11 is as described above. The other steps are similar to those of the method for manufacturing a ring rolled material of the first embodiment; accordingly, their descriptions are omitted.

Example

Ring rolling was carried out by a ring rolling mill having the mechanical elements illustrated in FIGS. 1 and 2 in the flow of control illustrated in FIG. 6. A ring-shaped material used for rolling was alloy 718. Its dimensions were an outer diameter of 900 mm, an inner diameter of 600 mm, and an axial thickness of 200 mm. Moreover, target dimensions of a ring rolled material at the end of rolling were an outer diameter of 1160 mm, an inner diameter of 930 mm, and an axial thickness of 190 mm. Δt was set to 0.09 sec, and the allowable error rate a to 0.26. Ring rolling was carried out at 1000° C.

Moreover, for the purpose of a comparison, ring rolling was carried out in the flow of control in which a measurement value of the diameter of the ring-shaped material was used as it is to calculate a new control speed of the axial rolls, without comparing $L_{t+\Delta t}$ and $L_t$, and comparing $[L_{t+\Delta t}-L_t]/L_t$ and a. However, the ring-shaped material was turned into an ellipse during ring rolling, and was severely deformed. Hence, ring rolling was stopped midway.

The dimensions of the ring rolled material after being ring rolled were measured. A caliper (measuring instrument) was used in the dimensional measurements to measure the outermost diameter, innermost diameter, and height of the ring rolled material at two points at every 90°. A difference between the maximum diameter and the minimum diameter upon measurement of the outer diameter was assumed to be the roundness.

The result of ring rolling is illustrated in table 1. As illustrated in table 1, it can be seen that the ring rolled material (example) ring rolled in the flow of control of the embodiment has a substantially intended stable dimensional shape. Moreover, a shape defect such as an ellipse was not observed, either.

TABLE 1

| | Rolling Dimensions [mm] | | | |
|---|---|---|---|---|
| | Outer Diameter | Inner Diameter | Height | Roundness |
| Comparative Example | 1058-1137 | 817-898 | 197 | 79 |
| Example | 1167-1171 | 930-935 | 191 | 4 |

Embodiments of the present disclosure may be the following first and second ring rolling mills and first and second methods for manufacturing a ring rolled material.

The first ring rolling mill is a ring rolling mill including a rotary drive main roll and a mandrel roll, which are for reducing the thickness of and rolling a ring-shaped material from the radial direction, a pair of rotary drive axial rolls for reducing the thickness of and rolling the ring-shaped material from the axial direction, a measuring roll for measuring the diameter of the ring-shaped material that is being rolled, and a speed control unit that controls the speed of the axial rolls. The speed control unit repeats a first step of measuring the diameter at predetermined time intervals Δt, a second step of comparing a measurement value Lt of the diameter at time t and a measurement value Lt+Δt of the diameter at time t+Δt, and a third step of setting a control speed based on the comparison result of the second step to control the speed of the axial rolls, and calculates and sets a new control speed based on Lt+Δt in the third step if the comparison result of the second step is Lt+Δt≥Lt, and maintains the control speed unchanged if the comparison result of the second step is Lt+Δt<Lt.

The second ring rolling mill is a ring rolling mill including a rotary drive main roll and a mandrel roll, which are for reducing the thickness of and rolling a ring-shaped material from the radial direction, a pair of rotary drive axial rolls for reducing the thickness of and rolling the ring-shaped material from the axial direction, a measuring roll for measuring the diameter of the ring-shaped material that is being rolled, and a speed control unit that controls the speed of the axial rolls. The speed control unit repeats a first step of measuring the diameter at predetermined time intervals Δt, a second step of comparing a measurement value Lt of the diameter at time t and a measurement value Lt+Δt of the diameter at time t+Δt, and a third step of setting a control speed based on the comparison result of the second step to control the speed of the axial rolls, and calculates and sets a new control speed based on Lt+Δt in the third step if the comparison result of the second step is Lt+Δt≥Lt and [Lt+Δt−Lt]/Lt≤α (α is a predetermined allowable error rate), and maintains the control speed unchanged if the comparison result of the second step is Lt+Δt<Lt or [Lt+Δt−Lt]/Lt>a.

The first method for manufacturing a ring rolled material is a method for manufacturing a ring rolled material using a ring rolling mill including a rotary drive main roll and a mandrel roll, which are for reducing the thickness of and rolling a ring-shaped material from the radial direction, a pair of rotary drive axial rolls for reducing the thickness of and rolling the ring-shaped material from the axial direction, a measuring roll for measuring the diameter of the ring-shaped material that is being rolled, and a speed control unit that controls the speed of the axial rolls. The speed control unit repeats a first step of measuring the diameter at predetermined time intervals Δt, a second step of comparing a measurement value Lt of the diameter at time t and a measurement value Lt+Δt of the diameter at time t+Δt, and a third step of setting a control speed based on the comparison result of the second step to control the speed of the axial rolls, and calculates and sets a new control speed based on Lt+Δt in the third step if the comparison result of the second step is Lt+Δt≥Lt, and maintains the control speed unchanged if the comparison result of the second step is Lt+Δt<Lt.

The second method for manufacturing a ring rolled material is a method for manufacturing a ring rolled material using a ring rolling mill including a rotary drive main roll and a mandrel roll, for reducing the thickness of and rolling a ring-shaped material from the radial direction, a pair of rotary drive axial rolls for reducing the thickness of and rolling the ring-shaped material from the axial direction, a measuring roll for measuring the diameter of the ring-shaped material that is being rolled, and a speed control unit that controls the speed of the axial rolls. The speed control unit repeats a first step of measuring the diameter at predetermined time intervals Δt, a second step of comparing a measurement value Lt of the diameter at time t and a measurement value Lt+Δt of the diameter at time t+Δt, and a third step of setting a control speed based on the comparison result of the second step to control the speed of the axial rolls, and calculates and sets a new control speed based on Lt+Δt in the third step if the comparison result of the second step is Lt+Δt≥Lt and [Lt+Δt−Lt]/Lt≤α (α is a predetermined allowable error rate), and maintains the control speed unchanged if the comparison result of the second step is Lt+Δt<Lt or [Lt+Δt−Lt]/Lt>a.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ring rolling mill comprising:

a rotary drive main roll and a mandrel roll, which are for reducing the thickness of and rolling a ring-shaped material from the radial direction;

a pair of rotary drive axial rolls for reducing the thickness of and rolling the ring-shaped material from the axial direction;

a measuring roll for measuring the diameter of the ring-shaped material during rolling; and a speed control unit for controlling the speed of the axial rolls, wherein the speed control unit is configured to repeat measuring the diameter at predetermined time intervals Δt, comparing a measurement value $L_t$ of the diameter at time t and a measurement value $L_{t+\Delta t}$ of the diameter at time t+Δt, and setting the speed of the axial rolls based on the result of the comparison, the speed control unit is further configured to maintain the speed of the axial rolls unchanged upon the result of the comparison being $L_{t+\Delta t}<L_t$ and the result of the comparison being $[L_{t+\Delta t}-L_t]/L_t>a$ (a is a predetermined allowable error rate), and the speed control unit is configured to calculate and set a new speed of the axial rolls based on $L_{t+\Delta t}$ upon the result of the comparison being $L_{t+\Delta t}\geq L_t$ and $[L_{t+\Delta t}-L_t]/L_t\leq a$.

2. A method for manufacturing a ring rolled material, comprising:

reducing the thickness of and rolling a ring-shaped material from the radial direction;

reducing the thickness of and rolling the ring-shaped material from the axial direction by a pair of rotary drive axial rolls;

measuring the diameter of the ring-shaped material during rolling; and controlling the speed of the axial rolls, wherein the controlling the speed of the axial rolls includes the repeated performance of measuring the diameter at predetermined time intervals Δt, comparing a measurement value $L_t$ of the diameter at time t and a measurement value $L_{t+\Delta t}$ of the diameter at time t+Δt, and setting the speed of the axial rolls based on the result of the comparison, and the setting the speed of the axial rolls based on the result of the comparison includes maintaining the speed of the axial rolls unchanged upon the result of the comparison being $L_{t+\Delta t}<L_t$ and the result of the comparison being $[L_{t+\Delta t}-L_t]/L_t>a$ (a is a predetermined allowable error rate).

3. The method for manufacturing a ring rolled material according to claim 2, wherein the setting the speed of the axial rolls based on the result of the comparison further includes calculating and setting a new speed of the axial rolls based on $L_{t+\Delta t}$ upon the result of the comparison being $L_{t+\Delta t}\geq L_t$.

4. The method for manufacturing a ring rolled material according to claim 2, wherein the setting the speed of the axial rolls based on the result of the comparison further includes calculating and setting a new speed of the axial rolls based on $L_{t+\Delta t}$ upon the result of the comparison being $L_{t+\Delta t}\geq L_t$ and $[L_{t+\Delta t}-L_t]/L_t\leq a$.

* * * * *